US012781527B2

(12) United States Patent
Hof

(10) Patent No.: US 12,781,527 B2
(45) Date of Patent: Nov. 3, 2026

(54) COVER DEVICE

(71) Applicant: Georg Hof, Purkersdorf (AT)

(72) Inventor: Georg Hof, Purkersdorf (AT)

( * ) Notice: Subject to any disclaimer, the term of this patent is extended or adjusted under 35 U.S.C. 154(b) by 289 days.

(21) Appl. No.: 18/562,360

(22) PCT Filed: May 13, 2022

(86) PCT No.: PCT/AT2022/060168
§ 371 (c)(1),
(2) Date: Nov. 20, 2023

(87) PCT Pub. No.: WO2022/241492
PCT Pub. Date: Nov. 24, 2022

(65) Prior Publication Data

US 2024/0240479 A1 Jul. 18, 2024

(30) Foreign Application Priority Data

May 20, 2021 (AT) ..... A 50399/2021

(51) Int. Cl.
*E04H 4/10* (2006.01)
*E04H 4/08* (2006.01)

(52) U.S. Cl.
CPC ..... *E04H 4/101* (2013.01); *E04H 4/082* (2013.01)

(58) Field of Classification Search
CPC ..... E04H 4/101; E04H 4/082
USPC ..... 4/498–502, 504
See application file for complete search history.

(56) References Cited

U.S. PATENT DOCUMENTS 3,832,263 A * 8/1974 Cleveland et al. ..... E04C 2/405 428/57
4,137,575 A * 2/1979 Klaffke ..... E04H 4/10 4/498
2010/0294331 A1* 11/2010 Carnation ..... H02S 30/20 126/561
2017/0198486 A1 7/2017 Stone, Jr.

FOREIGN PATENT DOCUMENTS

| | | |
|---|---|---|
| CH | 580733 | 10/1976 |
| DE | 8212252 | 8/1982 |
| DE | 8535505 | 3/1986 |
| DE | 8429962 | 12/1993 |
| GB | 2253184 | 9/1992 |

OTHER PUBLICATIONS

Internationaler Recherchenbericht und Schriftlicher Bescheid [International Search Report and the Written Opinion] Dated Aug. 23, 2022 From the International Searching Authority Re. Application No. PCT/AT2022/060168. (12 Pages).

* cited by examiner

*Primary Examiner* — Tuan N Nguyen

(57) ABSTRACT

Covering device (1) for liquid containers, in particular for swimming pools, comprising a support layer (2) and an insulation layer (3), wherein the covering device (1) is flexible and can be brought from a rolled-up state into a flat state for covering the liquid container, and wherein the support layer (2) and the insulation layer (3) in the flat state extend along a main extension plane (7) of the covering device (1), wherein the insulation layer (3) has a plurality of transverse slits (4) which, in the planar state, extend substantially parallel to one another and orthogonally to the main extension plane (7), so that the insulation layer (3) is divided by the transverse slits (4) into a plurality of insulation layer segments (8) preferably of substantially the same size.

15 Claims, 6 Drawing Sheets

COVER DEVICE

RELATED APPLICATIONS

This application is a National Phase of PCT Patent Application No. PCT/AT2022/060168 having International filing date of May 13, 2022, which claims the benefit of priority of Austria Patent Application No. A 50399/2021 filed on May 20, 2021. The contents of the above applications are all incorporated by reference as if fully set forth herein in their entirety.

FIELD AND BACKGROUND OF THE INVENTION

The invention relates to a covering device for liquid containers, in particular for swimming pools, which protects the container against both heat loss and vapor leakage as well as the ingress of foreign objects or impurities.

Covering devices of this type are known and are designed to assume a space-saving configuration when not in use. The state of the art describes covering devices that can be rolled up or folded to adopt the space-saving configuration. Covering devices are also known which are designed as a canopy arranged at a distance from the liquid surface and are telescopically retracted when not in use.

Such roofing for swimming pools are generally essentially vapor-tight, but in contrast to rollable or foldable solutions, they are bulky. In addition, the vapor space between the liquid surface and the enclosure usually results in high heat loss. Covering devices that are designed as foils take up less space and can be placed directly on the water surface, which prevents heat loss through evaporation. However, in order to save space, they are usually quite thin and therefore usually have poor thermal insulation properties. Lamella-type covering devices are also known. These offer a greater thickness of insulating material and can be rolled up, but they are not vapor-tight due to their articulated connecting elements, which in turn results in heat loss.

The disadvantages of known constructions are therefore at least that the thermal insulation properties are inadequate or that they cannot take up a space-saving configuration when not in use.

One of the tasks of the invention is to overcome this trade-off and to provide a covering device which, on the one hand, has good thermal insulation properties and, on the other hand, can be stowed away easily and in a space-saving manner.

These and other tasks of the invention are solved according to the invention by a device according to the independent patent claim.

SUMMARY OF THE INVENTION

A covering device according to the invention comprises a support layer and an insulation layer, wherein the covering device is flexible and can be brought from a rolled-up state to a flat state for covering the liquid container. In the flat state, the support layer and the insulation layer extend along a main extension plane of the covering device. According to the invention, it is provided that the insulation layer has a plurality of transverse slits which, in the flat state, run essentially parallel to one another and orthogonally to the main extension plane. Here, the term parallel also includes curved transverse slits that have identical curvature.

The insulation layer is divided into a large number of insulation layer segments by the transverse slits. The insulation layer segments are preferably essentially the same size. The main extension plane of the covering device is to be understood as any parallel plane in space that is spanned by the length and width of a covering device.

The thickness direction in which the thickness of a layer extends is orthogonal to the main extension plane. Thus, for example, in a special embodiment, the geometric shape of a rolled-out layer can be understood as a flat cuboid, whereby the thickness is many times smaller than the length and width of the cuboid. Thickness direction, length direction and width direction form an orthogonal coordinate system in three-dimensional space, whereby the covering device is preferably designed to be rolled up along the length direction and the transverse slits preferably run in the width direction.

The design according to the invention ensures that the covering device has a good thermal insulation effect in the flat state, since the insulation layer segments are only slightly spaced apart in this state or are in contact with each other. At the same time, the covering device can easily be brought into the space-saving rolled-up state, as in this state the transverse slits, which reduce the bending stiffness of the covering device, allow the covering device to be easily bent. In addition, the insulation layer segments being in contact in the flat state lead to an increased bending stiffness of the covering device with regard to an inner bending.

According to an embodiment of the invention, transverse slit surfaces are formed by the transverse slits, whereby, in the flat state, the transverse slit surfaces of adjacent insulation layer segments run essentially parallel to each other and are preferably in direct contact with each other. In the rolled-up state, the transverse slit surfaces are spaced apart and do not run parallel. This provides the necessary flexibility to achieve the respective configurations with little manual effort by the user. The transverse slits might have a depth that is less than or equal to the thickness of the insulation layer. This avoids construction-critical notch stress in the support layer.

According to an embodiment of the invention, the support layer and insulation layer are formed in one piece from a common material. Alternatively, the support layer and the insulation layer can also be made of different materials.

According to an embodiment of the invention, the support layer and insulation layer are connected to each other over their respective surfaces, whereby the insulation layer segments are preferably formed as separate insulation elements arranged on the support layer.

According to an embodiment of the invention, the insulation layer segments are pressure-braced together in the flat state by surface pressure of the transverse slits in the main extension plane, in particular with at least 2 $N/cm^2$, preferably with at least 5 $N/cm^2$. In particular, the volume of the insulation layer segments increases with increasing temperature. For example, the insulation layer segments can be pressure-braced in the flat state at a temperature above 20° C. and not pressure-braced at a lower temperature, such as below 10° C. or below 0° C. If the temperature rises, the insulation layer segments therefore tense themselves and ensure an increased thermal insulation effect. This effect can already be achieved during manufacturing of the insulation layer segments by creating the transverse slits at a low temperature, for example below 10° C.

According to an embodiment of the invention, the support layer is formed from a flexible polymer that comprises a UV stabilizer and/or is UV-stabilized.

The insulation layer can comprise or consist of a closed-pore plastic material, such as a polyethylene foam or a chloroprene rubber. This ensures the longevity of the covering device and allows the covering device to float on water. Furthermore, closed-pore plastic material is suitable for use in a damp, oxygen-containing environment with seasonal temperature fluctuations due to its chemically inert material properties.

According to an embodiment of the invention, in addition to the transverse slits, the insulation layer may also have longitudinal slits which divide the insulation layer segments into further segments and which form a grid shape with the transverse slits. This makes it possible to wind the covering device around non-cylindrical, for example barrel-shaped, winding devices with a centered winding, if necessary.

Furthermore, it may be provided that the insulation layer has an elastic foil or an elastic net covering the transverse slits, which may be connected to the insulation layer segments via fastening means. Preferably, the foil covers the transverse slits in the flat state and also when rolled up in order to protect the transverse slits from dirt. In particular, this enables the covering device to be rolled up protectively on both sides.

The invention also extends to an arrangement comprising a winding device and a covering device, wherein the winding device comprises a jacket surface for contacting the covering device. In the wound-up state of the covering device, the support layer is in contact with the outer surface of the winding device. This makes it possible for the winding device to bring the covering device into a space-saving configuration with as little force as possible.

In an embodiment of the invention, the winding device is provided as an essentially rotationally symmetrical, in particular cylindrical, body. This reduces the risk of wrinkling during winding.

In an embodiment of the invention, the winding device is designed as an essentially barrel-shaped body. This enables a self-centering effect during the winding process.

In an embodiment of the invention, the insulation layer is in contact with the surface of the water when unrolled. However, the support layer can also be in contact with the surface of the water when unrolled.

The entire covering device is preferably designed to be essentially fluid-tight and, if necessary, vapor- and/or water-tight. Preferably, the support layer forms the water- and vapor-impermeable layer of the covering device and also serves to support the insulation layer. The insulation layer serves to reduce the heat loss of the container to be covered.

The insulation layer can have a thickness of at least 1 cm, preferably 3 cm, or even at least about 10 cm. Furthermore, the thickness of the covering device can be at least 1 cm, preferably at least 3 cm, or even at least 6 cm.

Both the insulation layer and the support layer can be formed from or comprise a plastic, in particular a hydrophobic plastic. Preferably, the covering device floats independently on water and therefore has an average density of less than 1.0 g/cm$^3$. This prevents the formation of vapor under the covering device, which could subsequently lead to critical ice formation under the covering device at an ambient temperature of below 0° C.

The support layer may comprise or consist of a flexible plastic material, such as polyethylene with or without stabilizing mesh inserts. The insulation layer segments can have a length in the direction of the main extension plane of about 3 cm to 15 cm, preferably about 5 cm or about 8 cm. This achieves a flexibility of the covering device that is suitable for swimming pools.

The support layer can be thinner than the insulation layer. Preferably, the support layer is at least 70% thinner, in particular at least 85% thinner than the insulation layer. The support layer thickness can, for example, be less than 2 cm, preferably less than 1 cm.

It may be provided that the transverse slits have a depth that is less than the thickness of the insulation layer or that the transverse slits have a depth that is equal to the thickness of the insulation layer. As a result, the structurally critical points of the notches of the transverse slits are positioned either in the insulation layer or at the transition surface between the support layer and the insulation layer. Consequently, the extent of the maximum notch root stresses is reduced. The transverse slits can be designed as incisions into the material.

It may be provided that the support layer and the insulation layer are formed from different materials, which are preferably connected to each other over their entire surface, for example by a material bond, form-fit and/or force-fit. A material connection is preferably produced by gluing or welding, a form-fit connection preferably by mechanical connecting elements such as screws or bolts.

According to an embodiment of the invention, different materials for the support layer and insulation layer are used, where the support layer is formed from a material with a higher tensile strength than that of the insulation layer. This allows two different materials to be selected for the support layer and insulation layer and optimizes the fluid tightness, thermal insulation capacity and fatigue strength of the covering device.

The insulation layer segments or insulation elements are preferably rectangular or prismatic. This allows the insulation layer to be formed on the support layer in a flat state using joining technology, and the insulation elements can be applied to the support layer in a prestressed state.

The insulation segments are either applied to the support layer with a prestress or at a lower temperature. The insulation layer might also be attached to the support layer in a compressed form along the main extension plane.

In the former case, the prestressing leads to elastic deformation of the insulation elements. The prestressing remains in place even after joining, as the insulation elements cannot repel and relax due to the connection with the support layer.

The elastic deformation and the limited degrees of freedom of the insulation elements lead to compressive stress in the material of the insulation layer and to surface pressures on the surfaces of the transverse slits. Compressive stress and surface pressure may decrease with decreasing temperature, especially if the thermal expansion coefficient of the support layer is greater than that of the insulation layer. Surface pressure and compressive prestressing result in a wider temperature range down to below the freezing point, in which the transverse slits expand. This prevents increased heat loss at low ambient temperatures, where the insulating effect is particularly important.

In the second case, the insulation layer is applied to the support layer at a lower temperature than that of the support layer. After bonding the support layer and insulation layer, a compressive stress occurs in the insulation layer as soon as the two layers reach thermal equilibrium and the degrees of freedom of the insulation layer segments are restricted. The insulation layer segments are under compressive stress in the same way as the insulation elements in the first case.

Furthermore, it may be provided that the covering device has at least one edge region on which no insulation layer is provided. The edge region extends within the outer contour of the covering device and extends in the length direction or in the width direction. This results in at least one possibly bulging sealing lip, which is sufficiently elastic and flexible to cushion and also seal movements of the covering device in the length direction and/or width direction towards a container edge. This can improve the vapor tightness and insulation effect in the edge region of the covering device. If necessary, two edge regions can also be provided, which extend along two opposite sides of the covering device, whereby the edge regions may run essentially orthogonally to the transverse slits. A double edge region centers the covering device on the liquid surface of the liquid container and at the same time acts as a sealing lip against the inside of the container.

According to an embodiment of the invention, at least one edge region has a sealing strip designed as a tube or cord. Alternatively, a sealing body provided with a row of sealing lips can also be provided there. These parts can be made of rubber or comprise rubber. This ensures excellent thermal insulation also in the edge region.

It can also be provided that the heat transfer coefficient of the covering device, in particular the heat transfer coefficient of the insulation layer, is less than 5 $W/m^2$ K, in particular less than 2 $W/m^2$ K, preferably less than 1 $W/m^2$ K. The heat loss of the covered container to the environment is reduced to a minimum by a covering device or an insulation layer with the aforementioned heat transfer coefficient.

It may be provided that the width of the transverse slits in the flat state at a temperature below 10° C. is less than 500 μm, preferably less than 200 μm. The width of the transverse slits relates to the normal distance between the surfaces of the transverse slits. In a preferred embodiment, the width can also be zero; in this limiting case, the surfaces of the transverse slits are in contact with each other.

According to the invention, the covering device can be formed by providing a one-piece starting material for a support layer, bonding a one-piece starting material for an insulation layer to the support layer, and producing a plurality of transverse slits arranged parallel to one another by cutting into the starting material for the insulation layer, the transverse slits running essentially into the thickness direction of the starting material.

Furthermore, the covering device can be formed by providing a one-piece starting material for a support layer, connecting individual insulation elements for an insulation layer to the support layer so that transverse slits running essentially parallel to one another are formed between the insulation elements.

In addition, the covering device can be formed by providing a common one-piece starting material for a support layer and an insulation layer and producing a plurality of transverse slits arranged parallel to one another by cutting into the starting material, the transverse slits running essentially into the thickness direction of the starting material.

According to the invention, the manufacturing method of a covering device according to the invention can also comprise features of the first-mentioned and/or second-mentioned case for achieving the surface pressure on the transverse slit surfaces as well as further features of the description.

Further features of the invention can be deduced from the patent claims, the figures and the description of the embodiments.

The invention is explained below with reference to exemplary, non-exclusive embodiments.

DESCRIPTION OF SPECIFIC EMBODIMENTS OF THE INVENTION

Figure 1A:
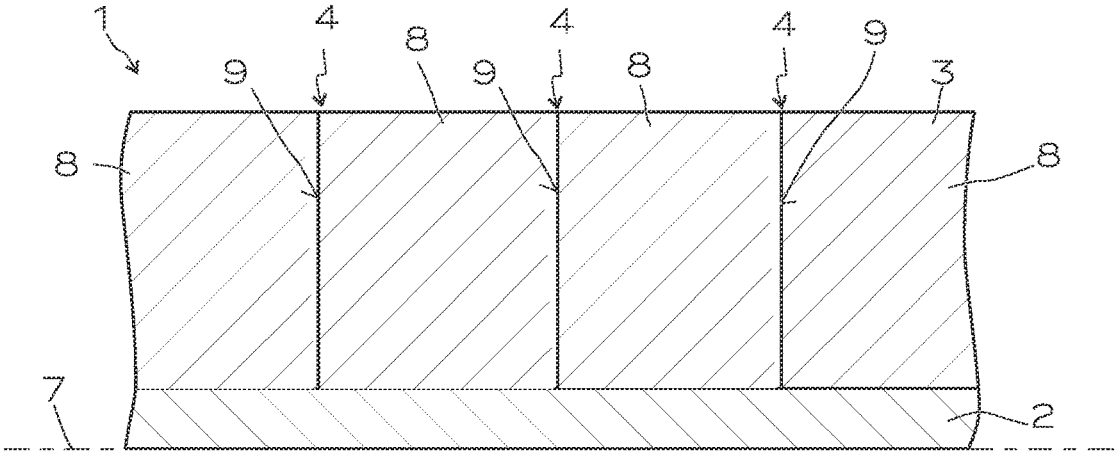
FIGS. 1*a*-1*c* show schematic sectional views of covering devices according to the invention.

FIG. 1*a* shows a schematic sectional view of a first embodiment of a covering device 1. A covering device 1 is shown in an unrolled and flat state. The support layer 2 is connected to the insulation layer 3 by means of joining technology, in particular by adhesive bonding. The main extension plane 7 runs along the underside of the support layer 2 and spans a plane in space, which in the selected view represents a line and also the lower edge of the support layer 2. The course of this illustrated line of the main extension plane 7 indicates the longitudinal direction of the covering device 1.

The insulation layer 3 is divided into insulation layer segments 8. In the embodiment shown, the depth of the transverse slits 4 essentially corresponds to the thickness of the insulation layer 3. In this embodiment, the insulation layer segments 8 are formed by individual insulating elements. Transverse slits 4 are provided between the insulation layer segments 8.

The width of the transverse slits 4 shown is zero, so that the two transverse slit surfaces 9 of a transverse slit 4 are adjacent to each other. In other embodiments not shown, this width can also be greater than zero.

In this schematic representation, the thickness of the support layer 2 is significantly smaller than the thickness of the insulation layer 3. The support layer thickness and insulation layer thickness are not shown to scale in the embodiment shown in FIG. 1*a*. In particular, the support layer 2 is designed as a foil and the insulation layer 3 is formed from individual insulation layer segments 8 made of closed-pore plastic. The material of the covering device 1 is weather-resistant and inert in an oxygen-containing environment.

The insulating elements were bonded to the support layer 2 in a pre-stressed manner or at a low temperature, as a result of which there is a positive compressive stress in the insulating elements at an ambient temperature of 25° C. in the flat state and therefore a positive surface pressure on the transverse slit surfaces 9 of the transverse slits 4. As the ambient temperature drops, the compressive stress may decrease, but a small positive surface pressure remains at least up to a lower limit of the ambient temperature of 0° C. This ensures that the transverse slits do not open significantly when the temperature drops to 0° C.

Figure 1B:
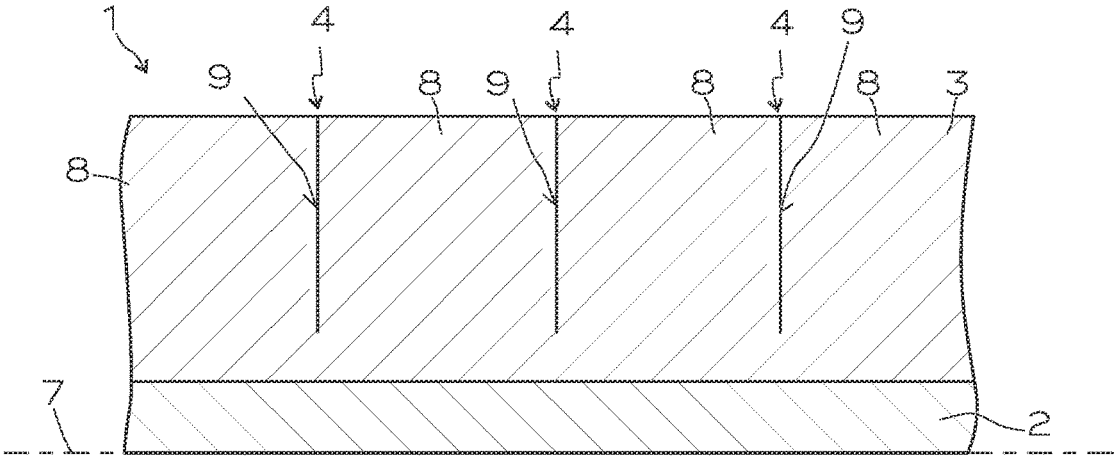

FIG. 1*b* shows a schematic sectional view of a second embodiment of a covering device 1. In contrast to the embodiment in FIG. 1*a*, the depth of the transverse slits 4 is less than the thickness of the insulation layer 3. The insulation layer 3 is in one piece and divided into insulation layer segments 8 by transverse slits 4. The insulation layer 3 is glued to the support layer 2.

Figure 1C:
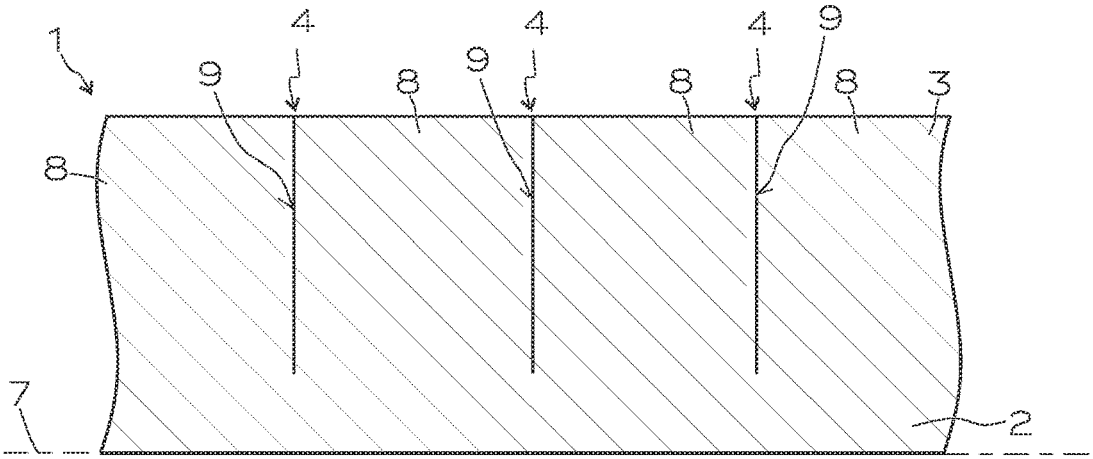

FIG. 1*c* shows a schematic sectional view of a third embodiment of a covering device 1. The entire covering device 1 consisting of support layer 2 and insulation layer 3 is in one piece. The transverse slits 4 and insulation layer segments 8 are formed according to the embodiment shown in FIG. 1*b*.

Figure 2:
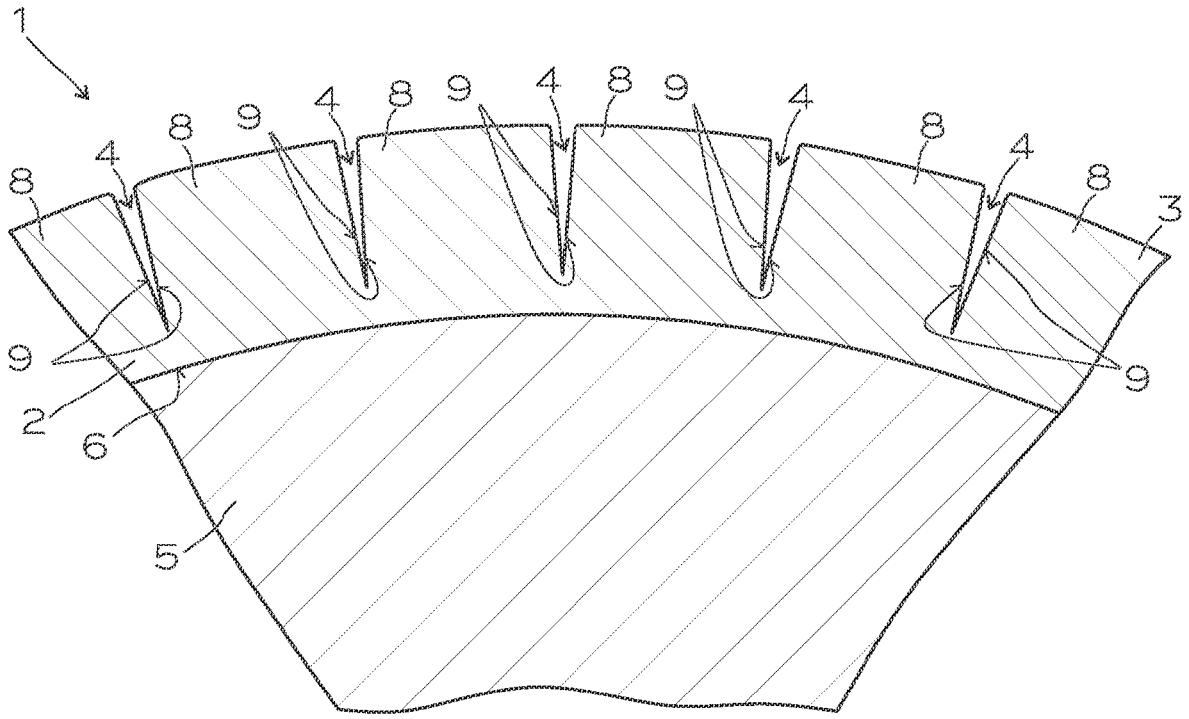
FIG. 2 shows a schematic representation of an embodiment of an arrangement according to the invention.

FIG. 2 shows a schematic representation of an embodiment of an arrangement of a covering device 1 on a winding device 5 according to the invention. The winding device 5 has a circumferential surface 6 which is in contact with the support layer 2.

In the embodiment shown, the winding device 5 is a cylindrical body that is rotated in order to wind the covering device 1. When a covering device 1 is arranged on the winding device 5, the insulation layer segments 8 are spread open and the transverse slits 4 form wedge-shaped openings.

Figure 3A:
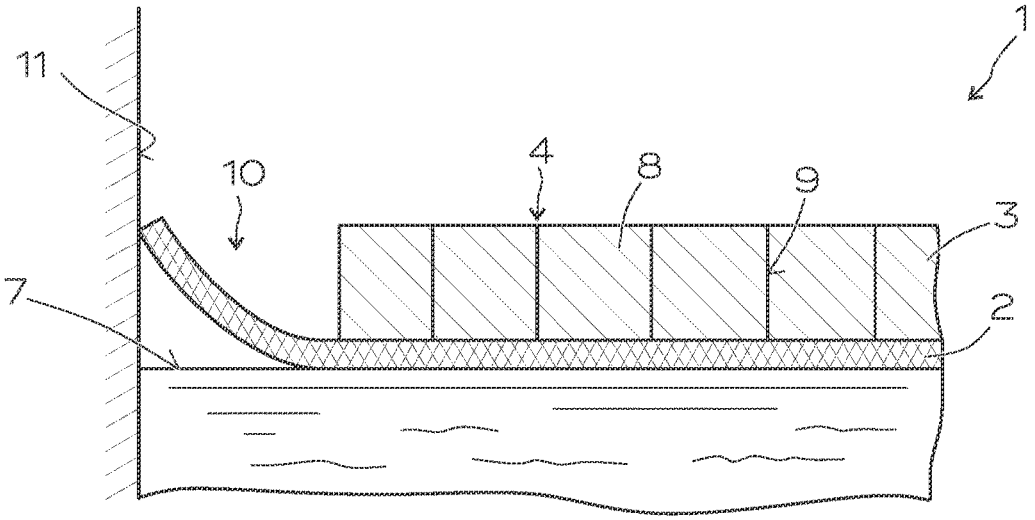
FIGS. 3*a*-3*d* show schematic representations of covering devices according to the invention.

FIG. 3*a* shows a schematic representation of the covering device 1 according to the invention from FIG. 1*a* in a swimming pool containing water. The support layer 2 lies directly on the water surface of the swimming pool, the water surface being surrounded by a pool edge 11. The water surface runs approximately parallel to the main extension plane 7 of the covering device 1.

Furthermore, the covering device 1 has an edge region 10 on which only the support layer 2 is provided. The edge region 10 seals the water surface against the pool edge 11. When the edge region 10 comes into contact with the pool edge 11, the edge region 10 curves upwards and forms a sealing lip, which reduces the heat dissipation at the edge regions 10 of the covering device 1.

Figure 3B:
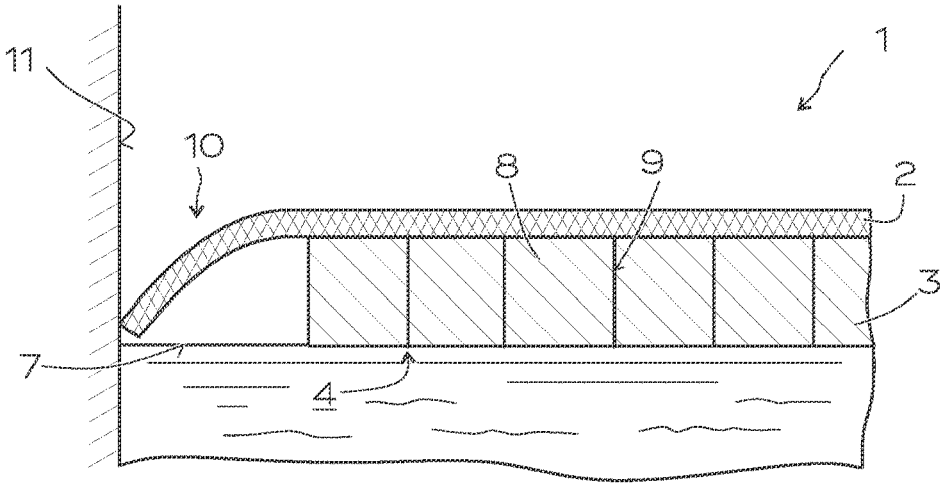

FIG. 3*b* shows a schematic representation of the covering device 1 according to the invention from FIG. 1*a* in a swimming pool containing water. In the embodiment shown, the insulation layer 3 lies directly on the water surface, with the water surface being surrounded by a pool edge 11.

Furthermore, the covering device 1 has an edge region 10 on which no insulation layer 3 is provided. The edge region 10 seals the water surface against the pool edge 11. When the edge region 10 comes into contact with the pool edge 11, the edge region 10 curves downwards and forms a sealing lip, which reduces the heat dissipation at the edge regions 10 of the covering device 1.

Figure 3C:
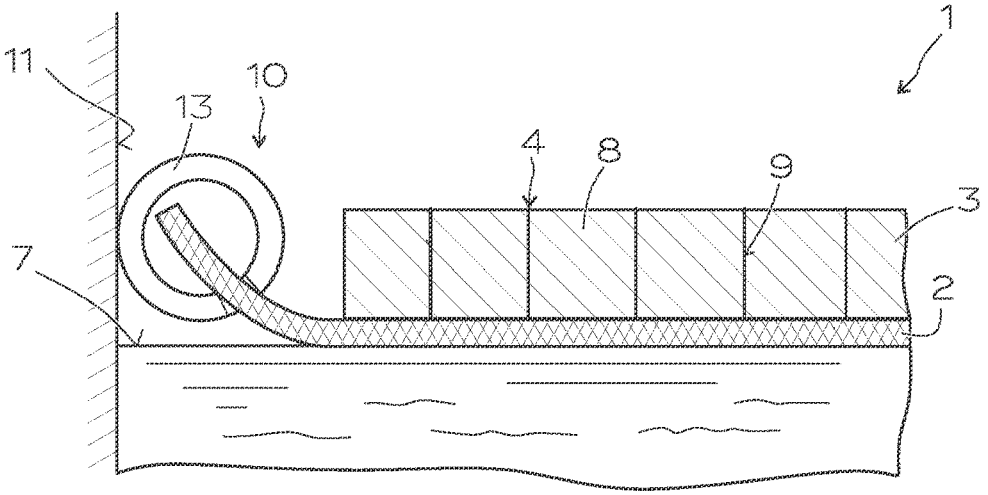

FIG. 3*c* shows a schematic representation of the covering device 1 according to the invention from FIG. 1*a* in a swimming pool. Here, the water surface between the edge region 10 and the pool edge 11 is sealed by a sealing strip 13.

In the embodiment shown, the sealing tape 13 is designed as a rubber tube with a slit. The tube is slipped over the edge region 10 of the support layer 2. In other embodiments, the sealing tape 13 does not have a slit but is connected to the edge region 10 on its outer side.

Figure 3D:
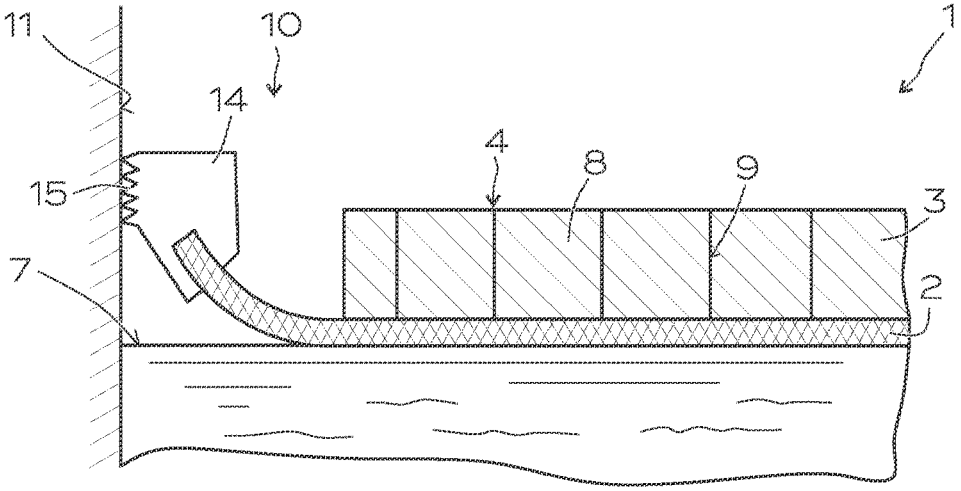

FIG. 3*d* shows a schematic representation of the covering device 1 according to the invention from FIG. 1*a* in a swimming pool. Here, the water surface between the edge region 10 and the pool edge 11 is sealed with a row of sealing lips 15 of a sealing body 14. The sealing body 14 is made of rubber and is connected to the edge region 10 or to the sealing lip.

Figure 4:
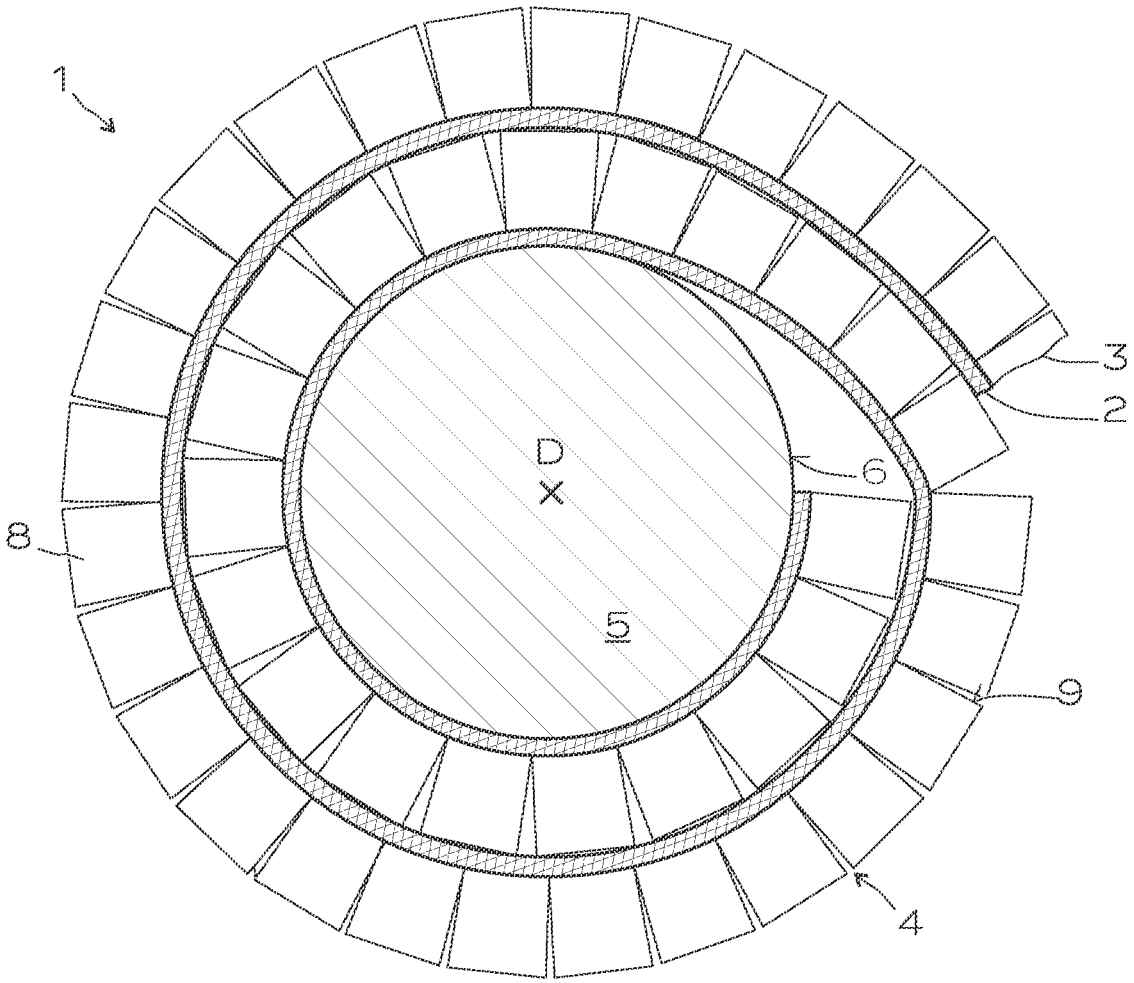
FIG. 4 shows a schematic representation of an embodiment of an arrangement according to the invention.

FIG. 4 shows a further schematic representation of an embodiment of an arrangement of a covering device 1 on a winding device 5 according to the invention. The support layer 2 and insulation layer 3 are designed the arrangement as shown in FIG. 1*a*. The winding device 5 has a circumferential surface 6 which is in contact with the underside of the support layer 2.

The winding device 5 is a cylindrical body that winds up the covering device 1 when it rotates around the axis of rotation D. When a covering device 1 is arranged on the winding device 5, the insulation layer segments 8 gape apart and the transverse slits 4 form wedges. The covering device 1 spirals around the winding device 5 until the entire length of the covering device 1 wraps around the winding device 5. This ensures that the configuration is as space-saving as possible.

In an embodiment not shown, the winding device 5 is designed as a hollow cylinder or as a non-cylindrical body, for example as a cuboid or hollow parallelepiped.

Figure 5A:
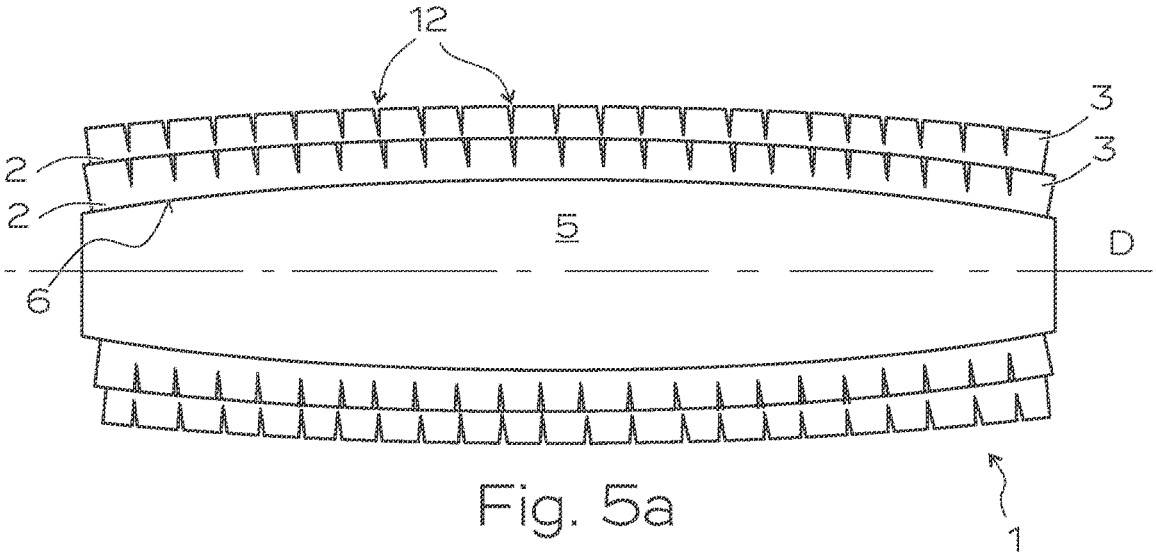
FIGS. 5*a*-5*b* show two further schematic representations of an embodiment of an arrangement according to the invention in the wound-up and rolled-up state.

FIG. 5*a* shows a further schematic representation of an embodiment of an arrangement of a covering device 1 on a winding device 5 according to the invention in the rolled-up state.

The winding device 5 is barrel-shaped. The transverse slits 4 of the covering device 1 are not visible and run essentially at right angles to the longitudinal slits 12 shown. Transverse slits 4 and longitudinal slits 12 form a rectangular grid. The longitudinal slits 12 extend through the entire insulation layer 3. Due to the barrel-shaped design of the winding device 5, the covering device 1 centers itself during winding on the winding device 5, which rotates around the axis of rotation D.

Figure 5B:
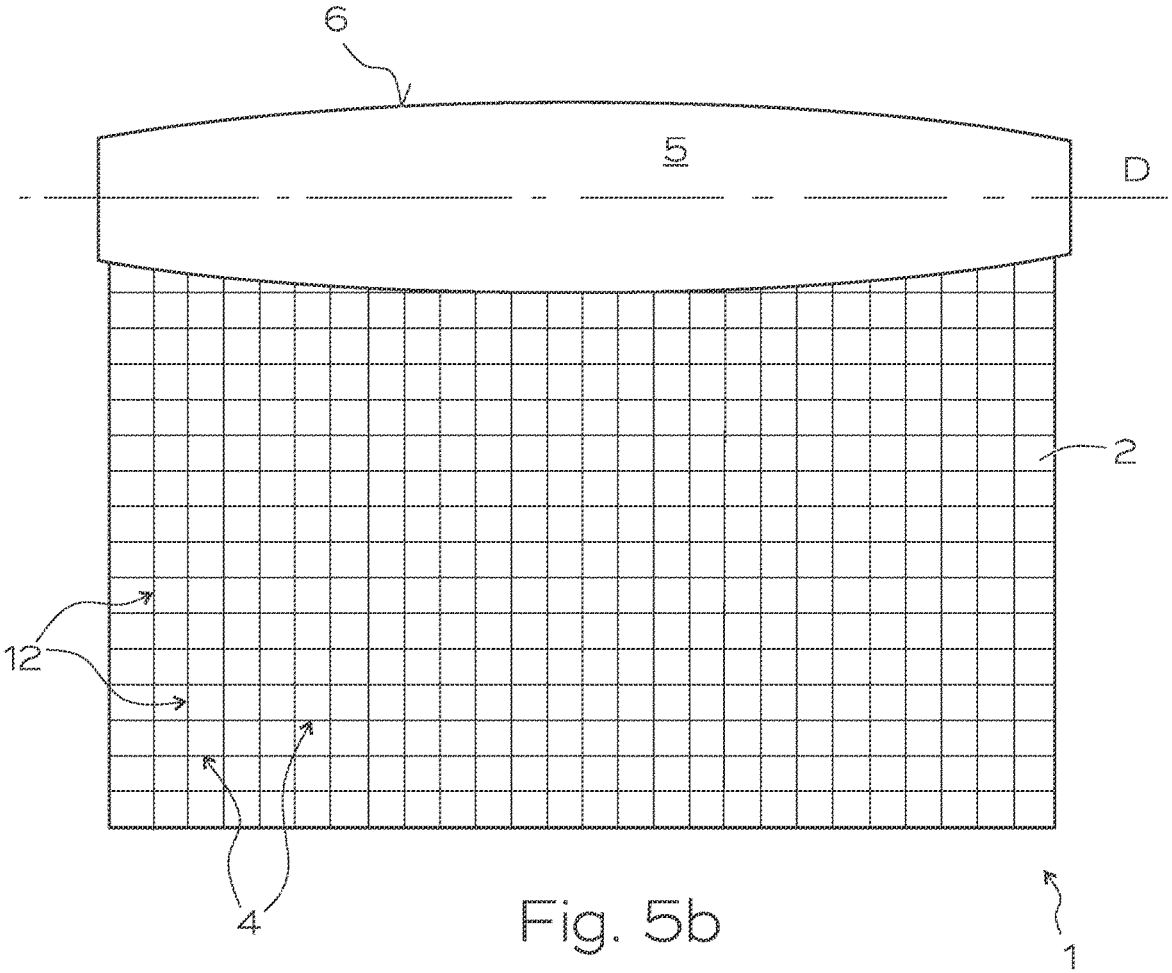

FIG. 5*b* shows a schematic top view of an embodiment of an arrangement of a covering device 1 on a winding device 5 according to the invention in the flat state. Transverse slits 4 and longitudinal slits 12 cross each other and form an essentially rectangular grid.

Figure 6:
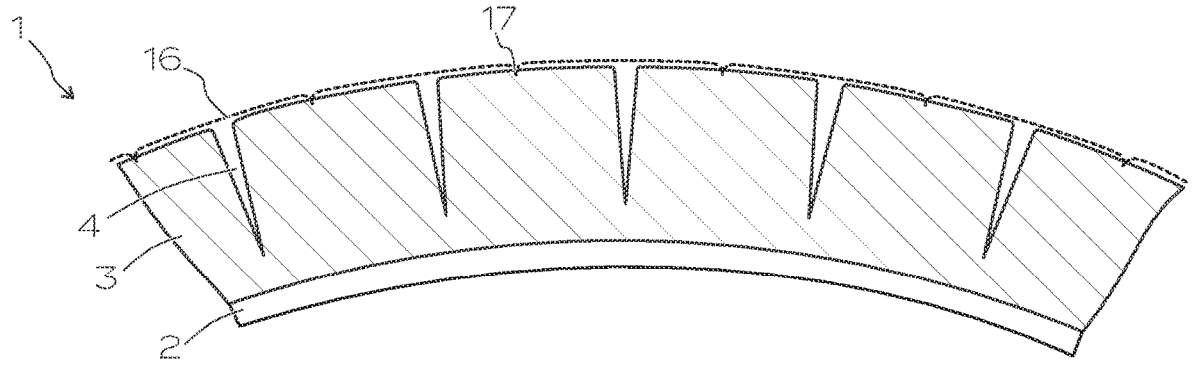
FIG. 6 shows a further embodiment of a covering device according to the invention.

FIG. 6 shows a further embodiment of a covering device according to the invention. In this embodiment, an elastic foil 16 or an elastic net covering the transverse slits 4 is provided, which is connected to the insulation layer segments 8 via fastening means 17. The fastening means 17 are, for example, nails or pins and are preferably arranged centrally on the surface of the insulation layer segments 8 in order to achieve maximum stretching of the foil 16 over the transverse slits 4. The foil 16 covers the transverse slits 4 in the rolled-up state shown in order to protect them from dirt and mechanical damage. The foil 16 is weather-resistant and can therefore also be used on the side facing away from the water surface. This embodiment makes it easier to roll up and unroll on both contact sides, so that either the insulation layer 3 or the support layer 2 can lie on the water surface.

REFERENCE SIGN

1 Covering device
2 Support layer
3 Insulation layer
4 Transverse slit
5 Winding device
6 Circumferential surface
7 Main extension plane
8 Insulation layer segments
9 Transverse slit surfaces
10 Edge region
11 Pool edge
12 Longitudinal slit
13 Sealing tape
14 Seal body
15 Sealing lip row
16 Foil
17 Fastening means

The invention claimed is:

1. A covering device for liquid containers comprising a support layer and an insulation layer, wherein the covering device is flexible and can be brought from a rolled-up state into a flat state for covering the liquid container, and wherein the support layer and the insulation layer extend along a main extension plane of the covering device in the flat state, wherein the insulation layer has a plurality of transverse slits which, in the planar state, extend substantially parallel to one another and orthogonally to the main plane of extension, so that the insulation layer is divided by the transverse slits into a plurality of insulation layer segments; wherein transverse slit surfaces are formed by the transverse slits, the transverse slit surfaces of adjacent insulation layer segments being essentially parallel to one another and in direct contact with one another in the flat state, and not being parallel to one another and being spaced apart in the rolled-up state; wherein the transverse slits have a depth which is less than the thickness of the insulation layer, the insulation layer being in one piece; wherein the insulation layer comprises a closed-pore plastic material; and wherein the covering device has an average density of less than 1.0 g/cm$^3$ so as to float on water.

2. The covering device according to claim 1, wherein the transverse slits have a depth positioning a notch root thereof within the insulation layer.

3. The covering device according to claim 1, wherein the support layer and insulation layer are formed in one piece from a common material.

4. The covering device according to claim 1, wherein the support layer and the insulation layer are formed from different materials which are joined together.

5. The covering device according to claim 1, wherein the insulation layer segments are pressure-braced together in the flat state by surface pressure of the transverse slits in the main extension plane.

6. The covering device according to claim 1, wherein the covering device has at least one edge region at which no insulation layer is provided, or in that two edge regions are provided which extend along two opposite sides of the covering device.

7. The covering device according to claim 1, wherein at least one edge region has a sealing strip designed as a tube or cord, or a sealing body provided with a row of sealing lips.

8. The covering device according to claim 1, wherein the support layer is formed from a flexible polymer which comprises a UV stabilizer.

9. The covering device according to claim 1, wherein the insulation layer has longitudinal slits which run essentially orthogonally to the transverse slits and divide the insulation layer segments into further segments.

10. The covering device according to claim 1, wherein the insulation layer has an elastic foil covering the transverse slits.

11. An arrangement, comprising the covering device according to claim 1 and a winding device, wherein the winding device comprises a circumferential surface for abutment of the covering device, wherein the support layer abuts against the circumferential surface of the winding device in the wound-up state of the covering device.

12. The arrangement according to claim 11, wherein the winding device is designed as a substantially rotationally symmetrical body.

13. The arrangement according to claim 11, wherein the winding device is designed as an essentially barrel-shaped body.

14. The arrangement according to claim 11, wherein the covering device is arranged on the winding device in such a way that the insulation layer lies against the surface of the medium in the liquid container when the covering device is unrolled.

15. The arrangement according to claim 11, wherein the covering device is arranged on the winding device in such a way that the support layer lies against the surface of the medium in the liquid container when the covering device is unrolled.

* * * * *